United States Patent [19]

Thompson et al.

[11] 4,081,294

[45] Mar. 28, 1978

[54] AVOIDING TYPE A LUDER LINES IN FORMING SHEET MADE OF AN Al-Mg ALLOY

[75] Inventors: David S. Thompson; John S. Prestley, Jr.; Grant E. Spangler, all of Richmond, Va.

[73] Assignee: Reynolds Metals Company, Richmond, Va.

[21] Appl. No.: 689,972

[22] Filed: May 26, 1976

Related U.S. Application Data

[63] Continuation of Ser. No. 527,412, Nov. 26, 1974, abandoned.

[51] Int. Cl.[2] ..... C22F 1/04

[52] U.S. Cl. ..... 148/11.5 A; 75/141; 75/146; 148/32

[58] Field of Search ..... 75/146, 141; 148/32, 148/32.5, 11.5 A, 2

[56] References Cited

U.S. PATENT DOCUMENTS

| | | | |
|---|---|---|---|
| 2,985,530 | 5/1961 | Fetzer et al. | 75/146 |
| 3,332,773 | 7/1967 | Dudas et al. | 75/146 |
| 3,802,931 | 4/1974 | Bylund | 148/11.5 A |

*Primary Examiner*—R. Dean

*Attorney, Agent, or Firm*—Glenn, Lyne, Gibbs & Clark

[57] ABSTRACT

Improved alloy compositions for making sheet products, and related method aspects, based on adding zinc to Al-Mg alloys in an amount effective to avoid Type A Luder lines when cold working such sheet in annealed condition.

13 Claims, No Drawings

AVOIDING TYPE A LUDER LINES IN FORMING SHEET MADE OF AN AL-MG ALLOY

This is a continuation of application Ser. No. 527,412 filed Nov. 26, 1974, abandoned.

This invention relates to sheet products made of aluminum base alloys, particularly magnesium-containing alloys, and it further concerns the use of small additions of zinc in Al-Mg alloys to avoid the problem of strain-induced imperfections known as "Luder lines."

Magnesium-containing alloys of the 5000 series generally have good formability in an annealed condition, but their use in various applications has been limited due to objectionable marks which appear during forming. Such marks can be so pronounced as to be visible even after painting the metal surface.

There are two types of Luder bands which occur in Al-Mg alloy sheet products. These are sometimes designated Type A and Type B. Type A is a random or Wedgeshaped marking developed at low strain levels, often as little as one quarter percent strain, while Type B is exhibited as a series of parallel ripples caused at strains greater than 2%. Type A lines correspond to a plateau in the stress-strain curve starting just above the elastic limit and extending up to about 1.5% or possibly 2% strain starting from annealed condition.

Instabilities in the form of sudden reductions in load can occur in this region of the stress-strain curve. Above about 2 to 3% strain the Type A lines disappear to be replaced by the Type B lines. In practice, however, the Type B lines are not as noticeable nor do they always appear under biaxial strain conditions.

It is generally understood that Luder line phenomena are associated with non-homogeneous deformation of the metal. Magnesium atoms tend to pin or anchor dislocations. They are larger than aluminum atoms and so are in a lower energy state when occupying lattice sites opposite to the extra half plane of atoms forming dislocations. In order to form a part, plastic deformation and, hence, dislocation motion is necessary. Pinned dislocations either drag the foreign magnesium atoms with them or they break away suddenly. In the latter process, once they have broken away, they need a lower stress to keep moving; thus, they keep moving or gliding more readily than dislocations which are still pinned. Hence, deformation is not uniform — occurring more in some places than others. In materials not suffering from Luder lines, pinning does not occur. Some dislocations will happen to move before others, but any slight increase in resistance to glide will transfer mobility to other initially immobile dislocations. Other Mg-bearing alloy systems tend not to suffer from dislocation pinning if a local order of atoms occurs. This can be accomplished by adding a third element, such as zinc, which is smaller than magnesium. A magnesium and a zinc atom together are more stable as a pair and are less likely to migrate to dislocations. Thus, pinning of dislocations is minimized.

It has been recognized in the art that the tendency of Al-Mg alloy sheet products to develop Type A Luder bands can be counteracted in several ways. One approach uses an additional cold rolling pass after annealing, to achieve a modest reduction in thickness of about 2% or more. Similar results apparently can be obtained by using relatively heavy roller leveling passes. These procedures have the advantage of being applicable to the sheet after it has been annealed following continuous cold rolling operations as normally practiced. However, the degree of cold working involved is quite low and tends to be not readily controlled. Thus final properties including formability are not predictable.

Another technique proposed, which also involves changing the mill practices used to produce the sheet, employs a carefully selected combination of cold rolling operations in successive stages with intermediate annealing between stages, in order to control grain size in the finished sheet at about 0.050 mm. This results in additional steps, particularly heating steps for annealing purposes, and the disadvantage of interrupted cold rolling practices, which complicate the production procedures and cause increased expense.

The present invention is concerned with improved techniques effective to avoid Type A markings, primarily by modifying the composition of Al-Mg alloys, and applicable for use in connection with conventional rolling practices.

In making cold rolled sheet of 1/32 to 1/16 inch thickness, for example, the metal is normally hot rolled to a convenient intermediate reroll gauge, typically about 1/10 to 1/4 inch, usually followed by a so-called hot line annealing operation, after which the metal is cold rolled from reroll gauge to finished thickness. Thus, the cold rolling operation accomplishes a reduction of at least about 40% and often as much as 60 to 80%. This hardens the metal appreciably, particularly in the case of Al-Mg alloys which work harden rapidly. Consequently, a final annealing treatment is used to produce "0" temper material of maximum ductility for forming. But these conventional practices have not been effective in making Al-Mg sheet for forming without the development of Type A Luder lines, largely because the heavy cold rolling reductions involved tend to accentuate the formation of a rather fine grained structure upon subsequent annealing. In summary, therefore, the routine mill practices considered most efficient and economical are not applicable to solving the problem of Luder lines in conventional Al-Mg alloy sheet products, and the modified practices previously proposed which are technically feasible are uneconomical and hence disadvantageous for that reason.

In accordance with the invention, it has been found that adding a small amount of zinc to magnesium-containing alloys makes it possible to achieve the desired results using the normal mill practices described above, including continuous cold rolling operations and final annealing to "0" temper, and such practices are thereby made applicable to the production of sheet adapted for forming without problems due to Type A Luder lines. Thus, for Al-Mg alloys having a magnesium content of at least about 3% by weight, the amount of zinc to be added is such as to obtain an alloy containing about 2 to 3% zinc, typically about 2.5% zinc for alloys containing about 4 to 5% magnesium.

Based on experience with zinc-modified versions of commercial alloy 5182, for example, an alloy variation containing 2% zinc showed only slight Type A yielding, and increasing the zinc content to 2.5% eliminated it entirely.

It may be noted that the registered composition limits of 5182 alloy are silicon 0.20 (max.), iron 0.35 (max.), copper 0.15 (max.), manganese 0.20–0.50, magnesium 4.0–5.0, chromium 0.10 (max.), zinc 0.25 (max.), titanium 0.10 (max.), other not exceeding .05 each and 0.15 total, balance aluminum.

For present purposes the terms "magnesium-containing alloy" and "Al-Mg alloy" are used with reference to aluminum base alloys containing up to about 10% magnesium as the principal alloying element by weight, including the regular wrought alloys of type 5XXX (Aluminum Association designations) having a magnesium content in the range of approximately 3 to 6%. Such alloys may also contain incidental impurities and minor addition elements, usually not exceeding about 1% in the aggregate, including silicon up to about 0.4%, iron up to about 0.5%, copper up to about 0.3%, manganese up to about 0.5%, chromium up to about 0.3%, titanium up to about 0.2% and, before modification in accordance with the invention, up to about 0.25% zinc by weight.

The particular advantages in using a zinc modification of Al-Mg alloys for present purposes, compared to other previously known approaches to avoiding the problem of Type A Luder lines, are readily apparent when considered in relation to some practical aspects of making sheet products in annealed condition. A zinc-modified Al-Mg alloy of the type described herein can be made into sheet by conventional mill practices of high efficiency, such as casting a large ingot, hot rolling the ingot to an intermediate reroll gage, and cold rolling continuously from the reroll gage to finished sheet thickness without interruption for intermediate annealing during the cold rolling sequence. The resulting sheet after final annealing to "0" temper exhibits the improved property of being formable without development of Type A Luder lines, and thus useful in forming operations such as those encountered in making autobody components and the like.

In contrast, when using the prior art technique of cold rolling an annealed sheet of ordinary Al-Mg alloy an additional 2% or more, a non-recrystallizing anneal would be needed subsequently to put the sheet in "0" temper and assure maximum formability, particularly since these alloys work harden so rapidly. Similarly, trying to use continuous cold rolling operations, without the necessary intermediate thermal treatments effective to control grain size, would run into the problem that previous extensive cold rolling reductions would tend to exaggerate the problem by cuasing a relatively fine grain size, thus increasing the likelihood of developing Type A Luder lines. As applied to regular 5182 alloy, for example, even using a practice involving interrupted cold rolling with intermediate annealing requires a delicate balancing of the annealing temperature and the maximum amount of cold rolling prior to annealing (eg. only about 20% reduction, with annealing at about 600° F.) to achieve a grain size as large as .050 mm.

The following example of the invention, based on a presently preferred composition (alloy No. 3), and including a comparison with similar alloys of lower zinc content, is provided for purposes of illustration and is not to be regarded as limiting:

EXAMPLE

Several alloys based on 5182 (4.5% Mg) were cast with the composition shown in Table I.

TABLE I

| Alloy No. | Compositions (Wt. %) Used in Example | | | | | | |
|---|---|---|---|---|---|---|---|
| | Si | Fe | Mn | Mg | Zn | Ti | |
| 1 | .09 | .22 | .34 | 4.45 | .01 | .005 | 5182 |
| 2 | .10 | .22 | .34 | 4.33 | 1.00 | .006 | 5182 + 1% Zn |

TABLE I-continued

| Alloy No. | Compositions (Wt. %) Used in Example | | | | | | |
|---|---|---|---|---|---|---|---|
| | Si | Fe | Mn | Mg | Zn | Ti | |
| 3 | .11 | .23 | .33 | 4.38 | 2.42 | <.005 | 5182 + 2.5 % Zn |

These alloys were cast as 2×4×6 book molds. They were homogenized for 4 hours at 1000° F, air cooled and scalped to 1.75 inch thickness. Hot rolling was carried out using a preheat of 775° F, reheating as necessary until the material was reduced to 0.120 inch gauge. The initial hot rolling consisted of rolling 9 inches long and then cross-rolling to 0.120 inch gauge. This hot rolled product was cold rolled to 0.040 inch gauge and annealed for approximately 2 hours at 700° F. The tensile properties of the resulting materials are given in Table II, together with an evaluation of the occurrence of Type A Luder lines.

TABLE II

| LONGITUDINAL TENSILE PROPERTIES | | | | | |
|---|---|---|---|---|---|
| Alloy No. | % Zn | Ult. Tensile Strength (ksi) | Yield Strength (ksi) | Elong. in 2" (%) | Presence of Type A Luder Lines |
| 1 | 0 | 41.3 | 20.2 | 23.0 | Yes |
| 2 | 1 | 42.6 | 20.2 | 25.3 | Yes |
| 3 | 2.5 | 49.0 | 22.6 | 25.0 | No |

What is claimed is:

1. A sheet metal product formed from a sheet of aluminum alloy in annealed condition, at least a portion of said product having been formed by straining said sheet about 0.25 to 3%, wherein said alloy consists essentially of about 3 to 6% magnesium, at least about 2% zinc in a percentage amount not exceeding magnesium content, and a balance of aluminum, said product, including said portion thereof, having been formed substantially free of Type A Luder lines.

2. The product of claim 1 wherein said portion of said product has been formed by straining said sheet less than 2%.

3. The product of claim 1 wherein said product is in the form of an exterior automotive body component.

4. The product of claim 1 wherein said alloy contains up to about 0.40% silicon, 0.50% iron, 0.25% copper, 0.50% manganese, 0.30% chromium, 0.15% titanium, and other not exceeding 0.05% each and 0.15% in total.

5. The product of claim 1 wherein said sheet has been made by cold rolling said alloy at least 40% to finished sheet thickness and then annealing said sheet.

6. The product of claim 5 wherein said sheet has been made by casting an amount of said alloy to form an ingot, hot rolling said ingot to an intermediate reroll gage of about 1/10 to 1/4 inch, and cold rolling said alloy from said reroll gage to said finished sheet thickness without intermediate thermal treatment.

7. The product of claim 6 wherein said sheet has been made by annealing said sheet to "0" temper after having been worked to said finished sheet thickness.

8. The product of claim 1 wherein said alloy contains about 4 to 5% magnesium and up to about 3% zinc.

9. The product of claim 8 wherein said alloy contains about 2.5% zinc.

10. The product of claim 9 wherein said alloy contains about 4.5% magnesium.

11. The product of claim 10 wherein said alloy contains 0.20 to 0.5% manganese and up to 0.20% silicon, 0.35% iron, 0.15% copper, 0.10% chromium and 0.10% titanium, and others not exceeding 0.05% each and 0.15% in total.

12. The product of claim 11 wherein said alloy contains about 4.5% magnesium and about 2.5% zinc.

13. The method for making a sheet metal product that is substantially free from Type A Luder lines, which comprises: hot rolling an aluminum base alloy down to an intermediate reroll gauge of about 1/10 to 1/4 inch, the alloy consisting essentially of about 3% to 6% magnesium, zinc in a percentage amount of at least about 2% but not exceeding the percentage amount of magnesium, and a balance of aluminum, cold rolling the hot rolled alloy to form sheet having a finished thickness of about 1/32 to 1/16 inch, the cold rolling being carried out without intermediate thermal treatment, annealing the cold rolled sheet, and straining the annealed sheet to form the sheet metal product, with at least a portion of the annealed sheet being strained about 0.25% to 3%.

* * * * *